US005915593A

United States Patent [19]

Bancon

[11] Patent Number: 5,915,593

[45] Date of Patent: Jun. 29, 1999

[54] APPARATUS FOR CONTINUOUSLY DISPENSING VISCOUS OR FLUID MATERIAL FROM A REMOVABLE TANK, HAVING A VARIABLE VOLUME STORAGE DEVICE

[75] Inventor: Georges Bancon, Chalon-sur-Saone, France

[73] Assignee: SEVA, Chalon-sur-Saone, France

[21] Appl. No.: 08/894,652

[22] PCT Filed: Mar. 6, 1996

[86] PCT No.: PCT/FR96/00349

§ 371 Date: Feb. 2, 1998

§ 102(e) Date: Feb. 2, 1998

[87] PCT Pub. No.: WO96/27448

PCT Pub. Date: Sep. 12, 1996

[30] Foreign Application Priority Data

Mar. 7, 1995 [FR] France ..... 95 02788

[51] Int. Cl.[6] ..... B67D 5/22

[52] U.S. Cl. ..... 222/41; 222/146.5; 222/386

[58] Field of Search ..... 222/1, 146.5, 325, 222/386, 405, 64, 39, 41

[56] References Cited

U.S. PATENT DOCUMENTS

| | | | |
|---|---|---|---|
| 3,815,222 | 6/1974 | Davies et al. . | |
| 5,443,796 | 8/1995 | Coeling et al. | 422/129 |

FOREIGN PATENT DOCUMENTS

| | | |
|---|---|---|
| 336138 | 10/1989 | European Pat. Off. . |
| 412978 | 11/1989 | European Pat. Off. . |
| 425866 | 5/1991 | European Pat. Off. . |
| 654297 | 5/1995 | European Pat. Off. . |
| 2599803 | 12/1987 | France . |
| 2626501 | 8/1989 | France . |
| 3824499 | 1/1990 | Germany . |
| 2187119 | 9/1987 | United Kingdom . |

*Primary Examiner*—Gregory L. Huson
*Attorney, Agent, or Firm*—Sughrue, Mion, Zinn, Macpeak & Seas, PLLC

[57] ABSTRACT

An apparatus for dispensing a viscous material includes a removable tank 1 and a device 10 for storing and dispensing the material, whereby the viscous material may be dispensed while an empty tank has been removed for refilling. The apparatus is useful for dispensing a hot-melt material.

6 Claims, 2 Drawing Sheets

APPARATUS FOR CONTINUOUSLY DISPENSING VISCOUS OR FLUID MATERIAL FROM A REMOVABLE TANK, HAVING A VARIABLE VOLUME STORAGE DEVICE

BACKGROUND OF THE INVENTION

The present invention concerns the delivery of viscous or fluid material. It relates, first, to a device for delivery of such products, of the type comprising a removable tank used to feed, in a fluid-tight manner, a device intended for delivery of said fluid through a fluid line incorporating pressurization means.

This known type of device proves advantageous (see French Patent Application No. 93 13 970 in the Applicant's name), but exhibits one restriction: the device stops when the tank holding the product is empty.

To obviate this difficulty, conventional practice entails the provision of two tanks. However, such a configuration causes multiple problems: attachment of the tank to the fluid line, pressurization of the product emanating from the second tank, the space required by this second tank, and the difficulty involved in using rigid ducts.

SUMMARY OF THE INVENTION

The invention is intended to remedy these difficulties and to prevent the formation of dead zones in which product accumulates.

To this end, the device according to the invention comprises means for storing and delivering the product or material emanating from the tank, these means being positioned in the continuity of the line and below the pressurization means, in the direction of flow.

According to other features:

- the storage/delivery means include an outlet-equipped duct positioned in the continuity of the line, and a chamber which empties into said duct, this chamber incorporating a plunger which, in the resting position, is flush with the duct and can move away from the duct in order to produce an accumulated volume of the product;
- the plunger is actuated by a jack, which is, in turn, actuated by a fluid controlled by a feeder which, upon actuation of a tank-level sensor, triggers the movement of the plunger up to a sensor of the lowered position of the plunger, which actuates data-emitting means designed to allow replacement of the tank;
- the fluid line comprises a non-return valve placed directly above the storage/delivery mechanism in the direction of flow, so as to avoid reverse flow of the viscous product or material when this mechanism is operating, thereby ensuring the safety of the device operator, who could be splattered with this product when the tank is changed;
- the storage/delivery mechanism is actuated in the delivery mode by a pressurized fluid-monostable feeder controlled manually or by a sensor which senses the lack of product in the tank, so as to adjust the pressure in the fluid line;
- the device incorporates a dynamic mixer between the storage mechanism and the delivery device;
- the storage mechanism incorporates a heating resistor.

The invention also concerns the use of a device conforming to the device described above for the delivery of heat-fusible material.

BRIEF DESCRIPTION OF THE DRAWINGS

One device, given solely as a non-limiting example of the invention, will now be described with reference to the attached drawings, in which.

DETAILED DESCRIPTION OF THE PREFERRED EMBODIMENT

Figure 1:
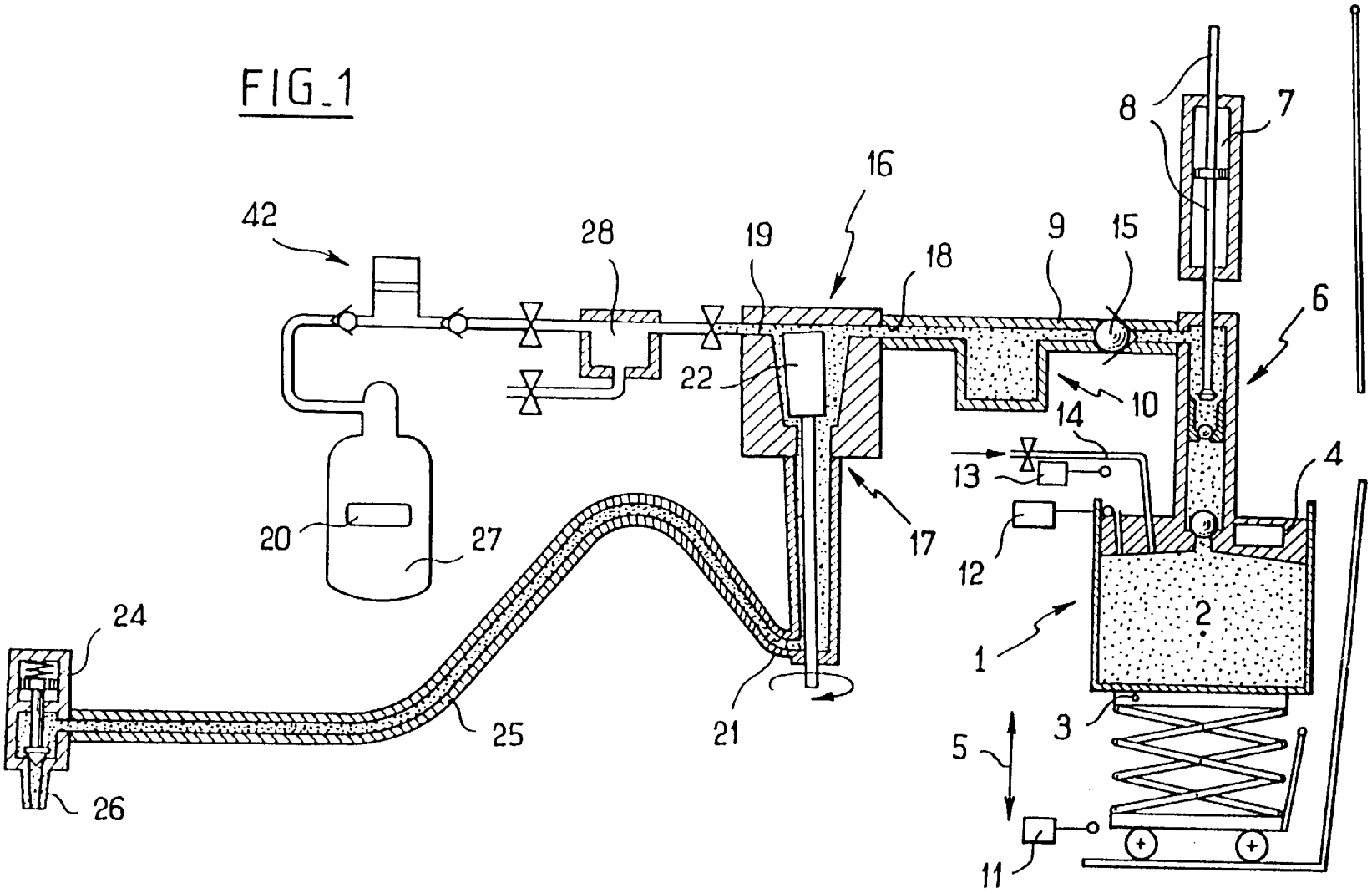
FIG. 1 illustrates diagrammatically a delivery device according to the invention.

The apparatus illustrated in FIG. 1 comprises a drum 1 forming a tank holding a thermoplastic viscous product 2, this drum being placed on an elevating platform 3.

The drum 1 is covered by a heating plate 4. The elevating platform 3 acts on the product 2 and the heating plate 4 by means of a hydraulic jack 5.

A double acting pump 6 controlled by a hydraulic jack 7 incorporating dual rods 8 is mounted on the plate 4.

The heating plate 4 is connected by means of a duct 9 to a mechanism 10 for the storage and delivery of the product 2. Level sensors 11, 13, 12 are placed in contact with the drum 1 in order to determine, respectively, whether it is full or empty and whether it must be replaced.

Product 2 is supplied by the drum 1 to the storage/delivery mechanism 10 by means of the rigid feed duct 9 equipped with a non-return valve 15.

The storage/delivery mechanism 10 is connected to a mixing device 16 located downstream in the direction of flow and comprising a fluid-tight container 17 fitted with a rigid duct 18 for feed of the viscous product 2, a nitrogen feed duct 20, and an outlet orifice 21. The container 17 incorporates an agitator 22.

A duct 25 connects the outlet 21 of the mixing device 16 to a delivery apparatus 24, which takes the form, for example, of a spray gun comprising an extrusion nozzle 26. The nitrogen 20 is held in a bottle 27 connected to an overpressure generator 42, which is in turn connected to an injection chamber 28 placed above the feed duct 19.

Figure 2:
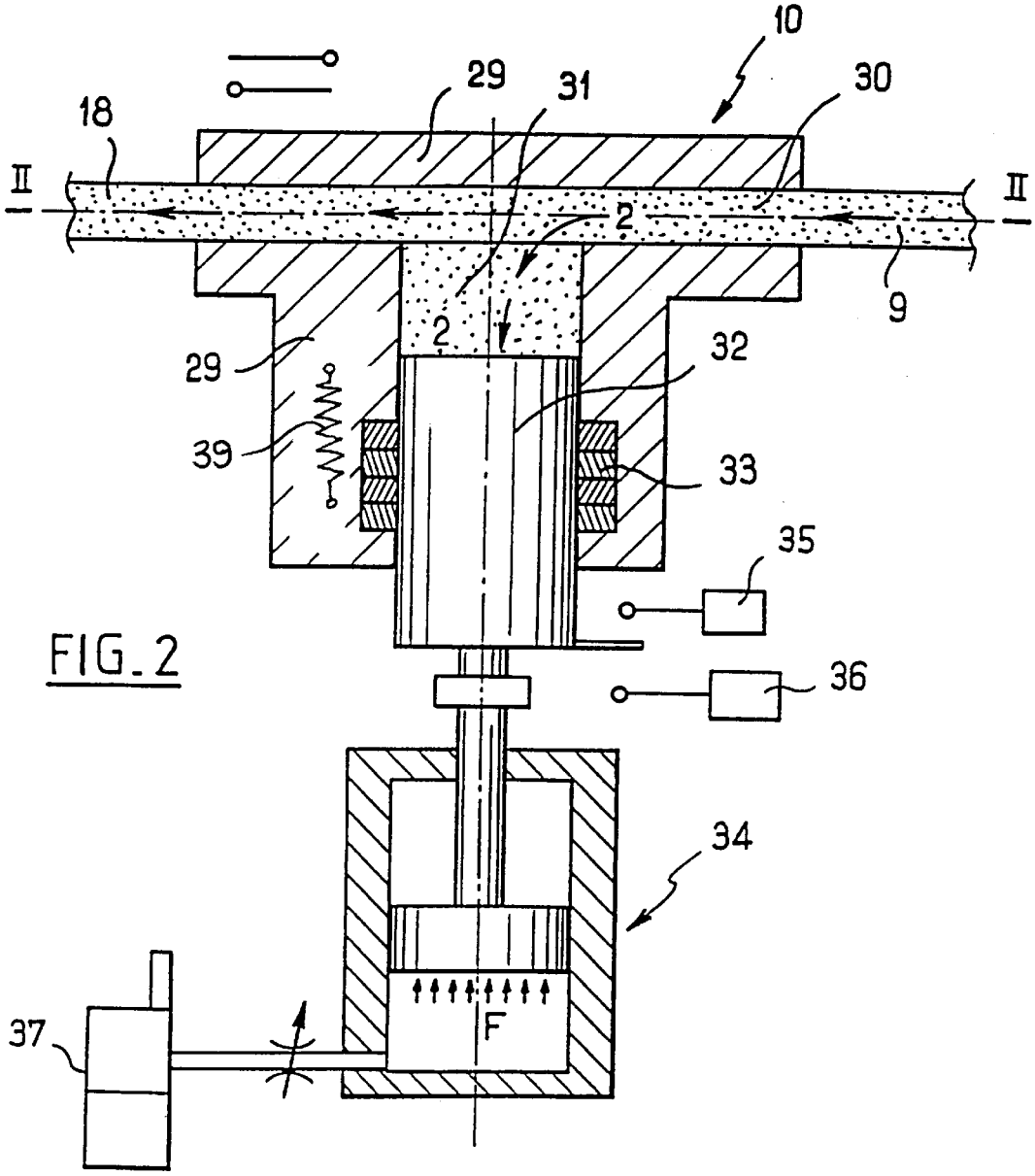
FIG. 2 is a vertical cross-section of a storage/delivery mechanism according to the invention.

The storage/delivery mechanism 10 shown in FIG. 2 comprises a machined part 29 forming a sleeve, through which passes an outlet-equipped duct 30 positioned in the continuity of the feed line and whose inlet and outlet diameter is identical to the inner diameter of the feed duct 9 and of the discharge duct 18. A chamber 31 having a diameter greater than the diameter of the duct 30 discharges into the duct 30 and perpendicularly to the latter. This chamber 31 incorporates a plunger 32 whose axis is also perpendicular to the axis of the duct 30 and which is flush with the duct 30 in the resting or retracted position and can move away from this duct 30 in order to produce a storage volume of the product 2. Fluid-tightness of the chamber 31 is ensured by a packing box 33 placed between the machined part 29 and the plunger 32. The sleeve 29 comprises a heating resistor 39 used to keep the product 2 at constant temperature.

The plunger 32 is actuated by a jack 34. The storage/delivery mechanism 10 comprises two sensors 35, 36 of the retracted and extended positions, respectively, of the plunger 32.

The jack 34 is actuated by a fluid F controlled by a feeder 37, this fluid causing movement of the plunger 32, upon actuation of the sensor 12 designed to sense the replacement level of the tank 1, up to the sensor 36 of the extended position of the plunger 32, which acts on data-emitting means allowing the tank 1 to be changed.

Figure 3:
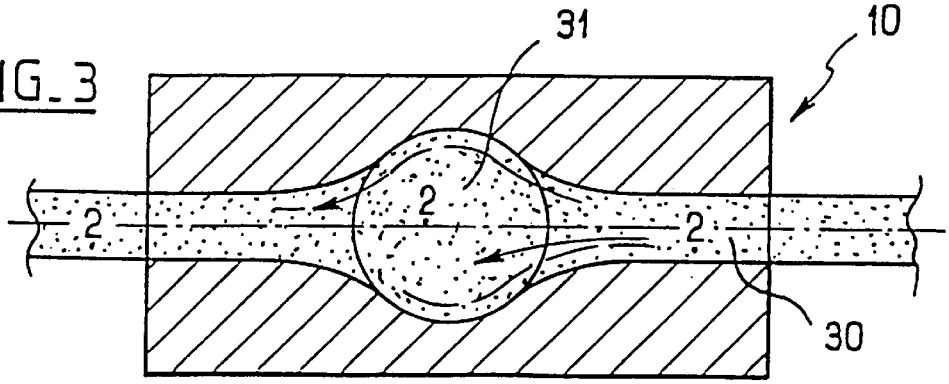
FIG. 3 is a vertical cross-section along line II—II in FIG. 2 of the storage/delivery mechanism.

As shown in FIG. 3, the duct 30 ensures continuity of movement of the product 2 by virtue of gradual enlargement up to the size of the diameter of the chamber 31, so as to avoid areas in which the product could cease to flow.

The apparatus functions in the following way.

The drum 1 is placed and centered on the elevating platform 3, which, by virtue the constant force generated by the jack 7, keeps the product 2 in contact with the plate 4. The product 2, whose pressurization in the duct 9 is ensured by the pump 6, is admitted directly into the storage/delivery mechanism 10. From this mechanism 10, the product is then fed to the mixing device 16.

The nitrogen 20 from the bottle 27 is fed to the hydropneumatic overpressure generator 42, which raises the pressure to about 300 bars. The pressurized nitrogen is fed into the mixer 16 through the feed duct 19, after passing through the injection chamber 28. By means of a movement of the agitator 22 inside the container 17, the product 2 and the nitrogen 20 are mixed, thus forming the material to be delivered, which leaves the mixer 16 through the outlet orifice 21. Under the effect of temperature and pressure, this material travels through the duct 25 to the spray gun 24, which extrudes it so as to form a sealing joint, for example, on any object to which it adheres.

When the product 2 leaves the drum 1, the level falls. As soon as the level of the product 2 is low, the sensor 12 is actuated, thus indicating to the operator that the drum must be replaced.

This sensor controls the movement of the plunger 32 from its retracted position in the chamber 31 by means of the jack 34 and the feeder 37, until the sensor 36 of the extended position of the plunger 32 is activated. The chamber 31 is then filled with product 2 under constant pressure generated by the pump 6, which functions with the lowest loss of head possible. In this way, the feed of product 2 to the spray gun 24 is not disrupted.

Once the chamber being filled with product 2, the operator triggers delivery of the product 2 by a reduction of the volume of the chamber 31 caused by retraction of the plunger 32. All of the product held in the chamber 31 is delivered to the mixing device 16, since it cannot flow back in the direction of the drum 1 because of the non-return valve 15 positioned directly upstream from the storage/delivery mechanism 10 in order to avoid reverse flow of the product 2 when this mechanism is functioning. The valve 15 ensures the safety of the operator who changes the drum 1. During this replacement procedure, delivery of the product 2 continues.

I claim:

1. Device for the delivery of viscous or fluid material, of the type comprising a removable tank (1) containing said material (2) and feeding a line comprising, in succession, pressurization means (6), a mechanism (10) for storage and delivery of the product (2), a mixing device (16), and a delivery mechanism (24), wherein the storage/delivery mechanism (10) comprises an outlet-equipped duct (30) positioned in the continuity of the line, and a chamber (31) discharging into said duct, this chamber (31) comprising a plunger (32) flush with the duct in the resting position and capable of moving away from the duct (30) so as to produce a storage space for the product (2).

2. Device for delivery of fluid or viscous material according to claim 1, wherein the plunger (32) is actuated by a jack (34).

3. Device according to claim 2, wherein the jack (34) is actuated by a fluid (F) controlled by a feeder (37), which, upon actuation of a sensor of the level of the tank (1), triggers movement of the piston (32) up to a sensor (36) of the extended position of the plunger (32), which triggers data-emitting means signaling the need to change the tank (1).

4. Device for delivery of fluid or viscous material according to claim 1, wherein the fluid line comprises a non-return valve (15) placed directly upstream from the storage/delivery mechanism (10) in the direction of flow, so as to avoid reverse flow of the viscous product or material (2) when said mechanism is functioning (10) and while the tank (1) is being replaced.

5. Device for delivery of fluid or viscous material according to claim 1, wherein the storage/delivery mechanism comprises a heating resistor.

6. Use of a device according to claim 1 for delivery of a heat-fusible material.

* * * * *